US008137146B2

(12) United States Patent
Cohen

(10) Patent No.: US 8,137,146 B2
(45) Date of Patent: Mar. 20, 2012

(54) CLOSED LOOP FLUID COOLING SYSTEM FOR MARINE OUTBOARD, INBOARD, AND INBOARD-OUTBOARD MOTORS

(75) Inventor: Joseph D Cohen, Denver, CO (US)

(73) Assignee: Vapor Trail Racing LLC, Denver, CO (US)

( * ) Notice: Subject to any disclaimer, the term of this patent is extended or adjusted under 35 U.S.C. 154(b) by 258 days.

(21) Appl. No.: 12/410,374

(22) Filed: Mar. 24, 2009

(65) Prior Publication Data

US 2009/0235877 A1 Sep. 24, 2009

Related U.S. Application Data

(60) Provisional application No. 61/070,424, filed on Mar. 24, 2008.

(51) Int. Cl.

| | |
|---|---|
| ***B63H 21/14*** | (2006.01) |
| ***F01P 3/20*** | (2006.01) |
| ***F02B 61/04*** | (2006.01) |
| *F28F 9/02* | (2006.01) |
| *F28F 9/04* | (2006.01) |

(52) U.S. Cl. ..... 440/88 C; 440/88 HE

(58) Field of Classification Search ..... 440/88 C; 123/41.08

See application file for complete search history.

(56) References Cited

U.S. PATENT DOCUMENTS

| | | | | |
|---|---|---|---|---|
| 6,544,085 | B1 * | 4/2003 | Menard et al. | 440/88 C |
| 6,869,324 | B2 * | 3/2005 | Matsuda | 440/88 C |
| 7,114,469 | B1 * | 10/2006 | Taylor | 123/41.08 |
| 7,503,819 | B1 * | 3/2009 | Jaeger et al. | 440/88 C |

* cited by examiner

*Primary Examiner* — Daniel Venne

(74) *Attorney, Agent, or Firm* — Polsinelli Shughart PC

(57) ABSTRACT

A closed loop fluid cooling system for marine motors is described. The system includes a motor cooling circuit in fluidic communication with fluid cooling jackets about a motor. The system includes a heat dissipation circuit. The motor cooling circuit is in closed fluidic communication with the heat dissipation circuit. A cooling fluid variably circulates between the motor cooling circuit and the heat dissipation circuit. A heat dissipation member is in fluidic communication with the heat dissipation circuit to receive the circulating cooling fluid, and the heat dissipation member is submerged in the body of water in which the boat is traveling to transfer heat from the cooling fluid to the body of water. A temperature control valve is in fluidic communication with the motor cooling circuit and the heat dissipation circuit. The temperature control valve variably connects the motor cooling circuit and the heat dissipation circuit in response to a temperature of the cooling fluid or the motor to provide for the circulation of the cooling fluid between the motor cooling circuit and the heat dissipation circuit.

21 Claims, 6 Drawing Sheets

CLOSED LOOP FLUID COOLING SYSTEM FOR MARINE OUTBOARD, INBOARD, AND INBOARD-OUTBOARD MOTORS

CROSS REFERENCE TO RELATED APPLICATION

This application claims priority to U.S. Provisional Patent Application No. 61/070,424 filed on Mar. 24, 2008.

FIELD OF INVENTION

The present invention relates to a closed loop fluid cooling system for marine outboard, inboard, and inboard-outboard motors.

BACKGROUND OF INVENTION

Most marine outboard, inboard, and inboard-outboard propulsion motors utilize a raw water-cooling system. Raw lake or sea water is drawn into the motor by a water pump or the movement of the boat to provide an active cooling process for the motor. The water is circulated through fluid cooling jackets of the motor in order to cool the motor, and the water is returned to the lake to dissipate the heat generated by the internal combustion occurring within the motor.

At the propulsion end or lower unit, marine motors generally incorporate an oil-filled gearbox containing gears that provide rotation for the propeller to provide propulsion for the boat. The gearbox operates while submerged in lake water. The propulsion end or lower unit generally includes an intake to supply cool water for "actively" cooling the engine. The water enters the intake, passes up through the lower unit, and about the engine's cooling jackets in order to cool the engine.

These conventional marine motor cooling systems are unable to regulate or control how much heat is dissipated from the motor. Consequently, in many (if not most) situations, the motor is being operated at a temperature below the optimum operating temperature of the motor. The active cooling is especially detrimental for the performance and operation of the motor during warm-up, a time when cooling should be halted.

Additionally, water within the fluid cooling jackets of a marine motor has an undesirable destructive effect on the motor. Water causes rust, scaling, corrosion, metal degradation by electrolysis, and fracture by freezing. These problems are amplified when the motor is operated in salt water. Operators are also bothered with draining these water-cooling systems to prevent damage from ice if the motor is stored or transported in freezing climates. Generally, many motors, especially the inboard-outboard motors, require the operator to winterize their motor by draining all the water from the cooling system. Salt water systems have to be regularly flushed with fresh water.

A new problem related to marine water-cooling systems has recently came into focus. Recreational boats unintentionally transport and spread unwanted invasive species throughout our country's lakes and rivers. Zebra muscles or other invasive species may be drawn into the cooling system and then migrate to another body of water by traveling in the residual cooling system water in the boat motor.

SUMMARY OF INVENTION

A closed loop cooling system is described herein. The closed loop cooling system reduces destruction to a marine motor caused by water with a conventional cooling system by replacing or converting the conventional cooling system to a closed fluid cooling system, which is filled with a cooling fluid, such as oil, (or other "metal friendly" cooling fluid) instead of raw lake or sea water.

The closed loop cooling system provides a quick warm-up of the internal combustion motor. The closed loop cooling system also elevates the operating temperature of oil in a gearbox of the motor, and resultantly, reduces the drag (power loss) of the gearbox and the motor drive train.

The closed loop cooling system maintains a predetermined optimum operating temperature of the motor through all conditions and situations.

The closed loop cooling system provided a closed system, which eliminates the need to drain, flush, or winterize the marine motor.

The closed loop cooling system overcomes the need for a on-board, manually-cleaned sea strainer to prevent the fouling of conventional cooling systems with seaweed, debris, fish, trash, etc. These strainers are often neglected, which can cause unwanted catastrophic failure of the marine motor.

The closed loop cooling system improves on the cooling systems of conventional outboards, which often use an impeller of a plastic/rubber material. Over time, the lake or sea water brought into the cooling system of the conventional outboard will cause the impeller to break-down, possibly resulting in engine failure. The impeller is especially susceptible to degradation from abrasion by sand in the water drawn into the cooling system in shallow water operation.

The closed loop cooling system provides a closed system, which eliminates the possibility of transporting invasive species and contaminating uninfected lakes and rivers by not taking raw water into the motor, or boat and storing it during transportation of the boat.

Overall, the closed loop cooling system improves the performance of a marine motors, as can be measured as an improvement in power, responsiveness, fuel efficiency, reduction of exhaust emissions, and overall engine life.

Overall, the closed loop cooling system provides a marine motor with an engineered level of immunity to the destructive forces of water.

BRIEF DESCRIPTION OF DRAWINGS

FIG. 1(*b*) is a schematic representation of the closed loop cooling system in the heat dissipation mode.

DETAILED DESCRIPTION OF THE INVENTION

Figure 1B:
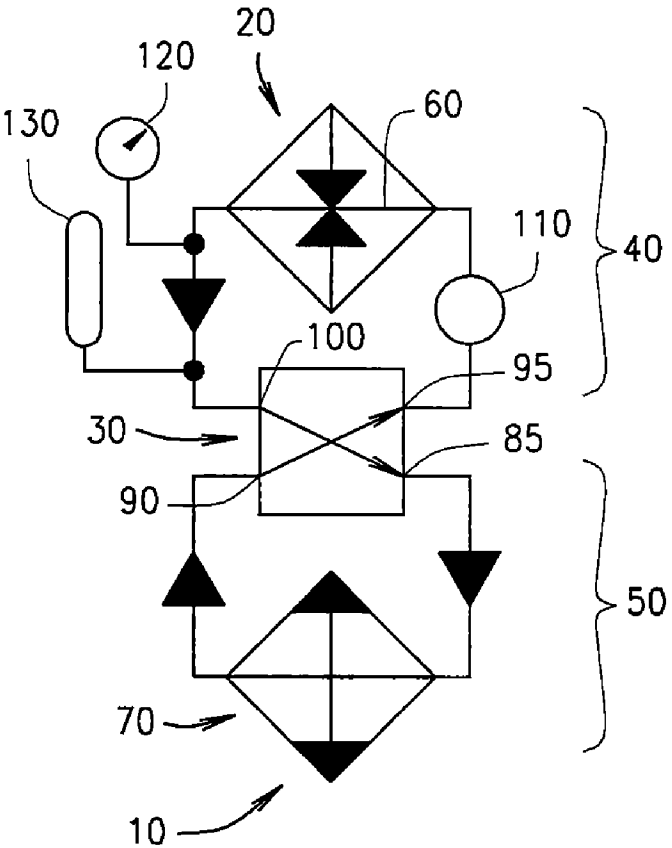
FIG. 1(*a*) is a schematic representation of the closed loop cooling system in the heat preservation mode.

A closed loop fluid cooling system for a marine motor is described. The closed system circulates a cooling fluid, such as oil, instead of raw water, through the fluid cooling jackets of the marine motor. A flow path of the cooling fluid through the closed loop cooling system is generally circular between a motor cooling circuit and a heat dissipation circuit. The closed loop cooling system is closed, as such, water from the lake, sea, etc. is not typically allowed to enter the cooling system under the intended or normal operating conditions of the cooling system.

The closed loop fluid cooling system comprises the motor cooling circuit and the heat dissipation circuit in closed fluidic communication by a valve. The motor cooling circuit and the heat dissipation circuit are used to continuously circulate the cooling fluid about the motor, and variably circulate cooling fluid about a gearbox of the motor in order to cool the motor and to maintain an optimal operating temperature for the motor. The closed loop cooling system also variably circulates the cooling fluid to the heat dissipation circuit to dissipate heat and cause the gearbox to heat up to an elevated temperature in order to more quickly reach an elevated optimal operating temperature for the gear oil.

The motor cooling circuit is in fluidic communication with cooling jackets about the motor. The cooling jackets are proximate to the motor to receive heat from the motor and to transfer the heat into the fluid cooling system. The cooling jackets are generally integrated within engine block of the motor. The motor cooling circuit is further in fluidic communication with the valve.

The heat dissipation circuit is in fluidic communication with a heat dissipation member, which is submerged in a body of water, such as a lake or the sea, to transfer heat from the cooling fluid to the body of water. As described herein, the heat dissipation member includes multiple different structures or designs that are submerged in the body of water to place the cooling fluid of the cooling system in close thermal contact with the body of water. The hot cooling fluid passes through the heat dissipation circuit to the heat dissipation member and then back to the heat dissipation circuit.

The heat dissipation circuit may be in fluidic communication with an interior of a lower unit and gearbox of the motor, which acts as the heat dissipation member. The lower unit comprises the submerged gearbox. The heat dissipation circuit is further in fluidic communication with the valve to receive the cooling fluid from the motor cooling circuit. As such, the heat dissipation circuit transfers the cooling fluid to and from the submerged gearbox in the lower unit of the motor. The circulation of the cooling fluid from the motor cooling circuit to and from the gearbox, acting as the heat dissipation member, cools the cooling fluid. The cooled cooling fluid is returned to the motor cooling circuit to draw additional heat from the motor.

Figure 1A:
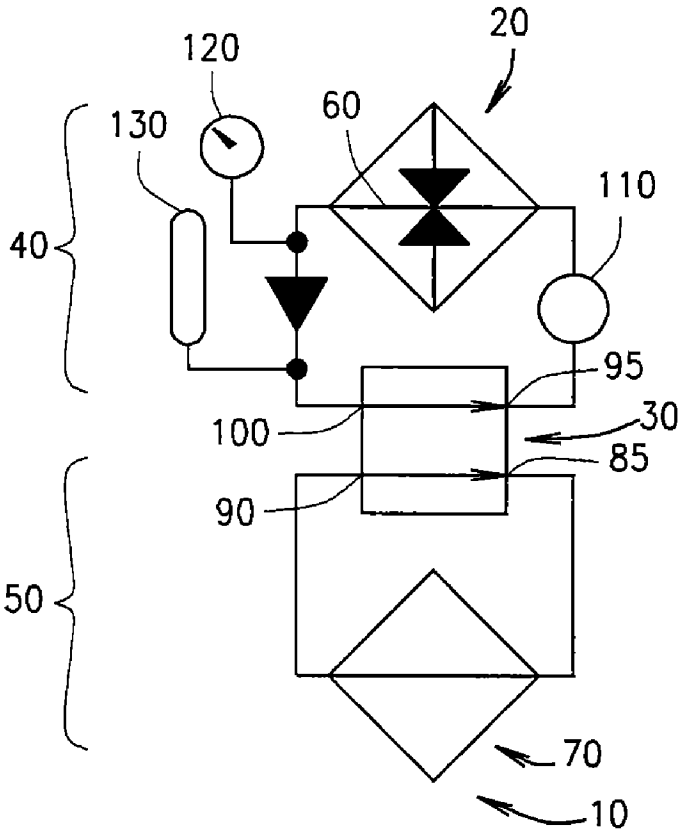

FIG. 1(*a*) shows a schematic representation of a heat preservation mode of a cooling system 10 for a marine motor 20. FIG. 1(*b*) shows a schematic representation of a heat dissipation mode of the cooling system 10. The marine motor 20, having a "cold" operational status, will begin operation in the heat preservation mode, as shown in FIG. 1(*a*). As the temperature of the marine motor 20 elevates during the warm-up of the marine motor 20, the marine motor 20 using the cooling system 10 quickly reaches its optimum operating temperature. The marine motor 20 reaches this temperature faster than a conventional marine motor, since, during the warm-up of the marine motor 20, little or no heat is being dissipated to the lake or sea water.

When the operating temperature elevates to or approaches an optimum operating temperature of the marine motor 20, a temperature control valve 30 makes a fluidic connection between a motor cooling circuit 40 and a heat dissipation circuit 50, and begins to circulate the cooling fluid through the cooling system 10, which circulates the cooling fluid through cooling jackets 60 of the marine motor 20 and through a gearbox 70 in a submerged lower unit of the marine motor 20. The cooling system 10 is now in the heat dissipation mode. Heat transferred from the marine motor 20 to the cooling fluid travels through the gearbox 70, which acts as the heat dissipation member to dissipate heat into the passing lake or sea water. In this unique method of dissipating motor heat, the operating temperature of the cooling fluid being circulated through the gearbox 70 has been elevated from the motor cooling circuit 40, desirably reducing the drag of the gearbox 70.

The motor cooling circuit 40 is in fluidic communication with the cooling jackets 60 about the marine motor 20. The cooling jackets 60 are proximate to the marine motor 20 to receive heat from the motor 20 and transfer the heat into the fluid within the cooling system 10. The cooling jackets 60 are generally integrated within an engine block of the marine motor 20. The motor cooling circuit 40 is further in fluidic communication with the temperature control valve 30.

The heat dissipation circuit 50 is in fluidic communication with the interior of the lower unit of the marine motor 20, which operates submerged in the lake/sea water. The lower unit comprises the gearbox 70, which acts as the heat dissipation member. The heat dissipation circuit 50 is further in fluidic communication with the temperature control valve 30 to receive the cooling fluid from the motor cooling circuit 40. As such, the heat dissipation circuit 50 transfers the cooling fluid to and from the gearbox 70 in the lower unit of the marine motor 20. The circulation of the cooling fluid from the motor cooling circuit 40 to the gearbox 70 cools the cooling fluid. The cooled cooling fluid is returned to the motor cooling circuit 40 to draw additional heat from the marine motor 20.

The gearbox 70 generally does not have the heat dissipation requirements of the marine motor 20, due to the close proximity of the gearbox 70 to the lake, sea, or body of water. Generally, the gearbox 70 is submerged in the lake, sea, or body of water and such submersion continually cools the gearbox 70. Any heat dissipated into the gear lubricant in the gearbox 70 from the friction of the gears is immediately dissipated into the lake water surrounding and, when the boat is in motion, passing by the gearbox 70.

The elevation of gearbox lubricant temperature during the operation of a conventional marine motor is minimal. However, gearboxes operate more efficiently when they have been warmed up. The cooling system 10 also provides the cooling fluid that has been heated by the marine motor 20 to heat up the gearbox 70 and the gearbox lubricant, providing for more efficient operation of the gears in the gearbox 70.

The closed loop cooling system 10 comprises the temperature control valve 30 to exchange the cooling fluid between the motor cooling circuit 40 and the heat dissipation circuit 50. The temperature control valve 30 has one or more ports to receive in and to output the cooling fluid to the motor cooling circuit 40 and to the heat dissipation circuit 50.

The temperature control valve 30 includes a heat dissipation circuit outlet port 85 and heat dissipation circuit inlet port 90. The heat dissipation circuit outlet port 85 provides the cooling fluid to the heat dissipation circuit 50. The heat dissipation circuit inlet port 90 receives fluid from the heat dissipation circuit 50. The temperature control valve 30 further includes a motor cooling circuit outlet port 95 and a motor cooling circuit inlet port 100. The motor cooling circuit outlet 95 port provides fluid to the motor cooling circuit 40. The motor cooling circuit inlet port 100 receives fluid from the motor cooling circuit 40.

A pump 110 creates the flow of the cooling fluid through the cooling system 10. The pump 110 can be powered by either a direct drive, crankcase pressure, an electrical motor, a water turbine powered by boat movement, or any combination of these.

Thermal sensors 120 may also be incorporated in the valve 30, gearbox 70, the marine motor 20, the heat dissipation circuit 50, the engine cooling circuit 40, or at other positions in the cooling system 10 to measure temperature. The thermal sensors 120 are in operational communication with a flow control valve, such as the temperature control valve 30, to provide the current temperatures of the various components, circuits, or the cooling fluid at various positions. Based on the measured temperatures from the thermal sensors 120, the flow control valve may adjust the flow of the cooling fluid to and from the heat dissipation circuit 50.

An expansion chamber 130 is incorporated into the cooling system 10 to allow for thermal expansion of the cooling fluid. The expansion chamber 130 provides a permanent air gap to accommodate thermal volumetric expansion of the cooling fluid. An optional reservoir in fluidic communication with the cooling system 10 may store excess cooling fluid.

The operation of the fluid cooling system 10 will now be described with reference to the Figures. The cooling system 10 may be adapted to a variety of different marine motors and configurations. In certain embodiments, the cooling fluid lubricates the gears in the gearcase, while also circulating about the motor for cooling.

Figure 2:
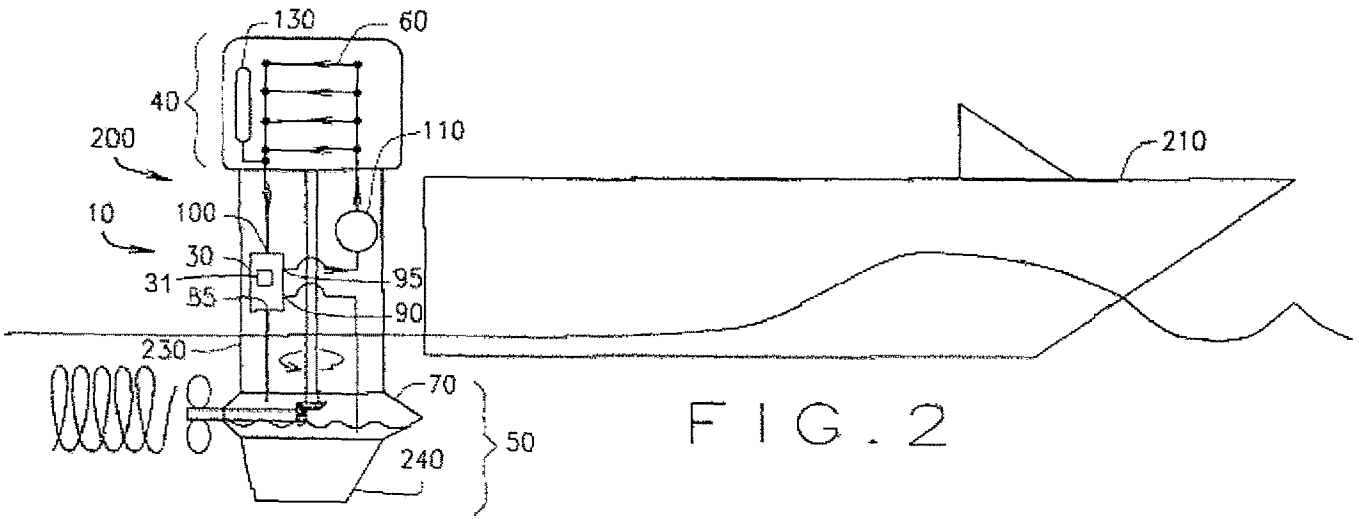
FIG. 2 is a view of the outboard motor incorporating the closed loop cooling system with the cooling fluid in common with the gearbox in the heat preservation mode.
Figure 3:
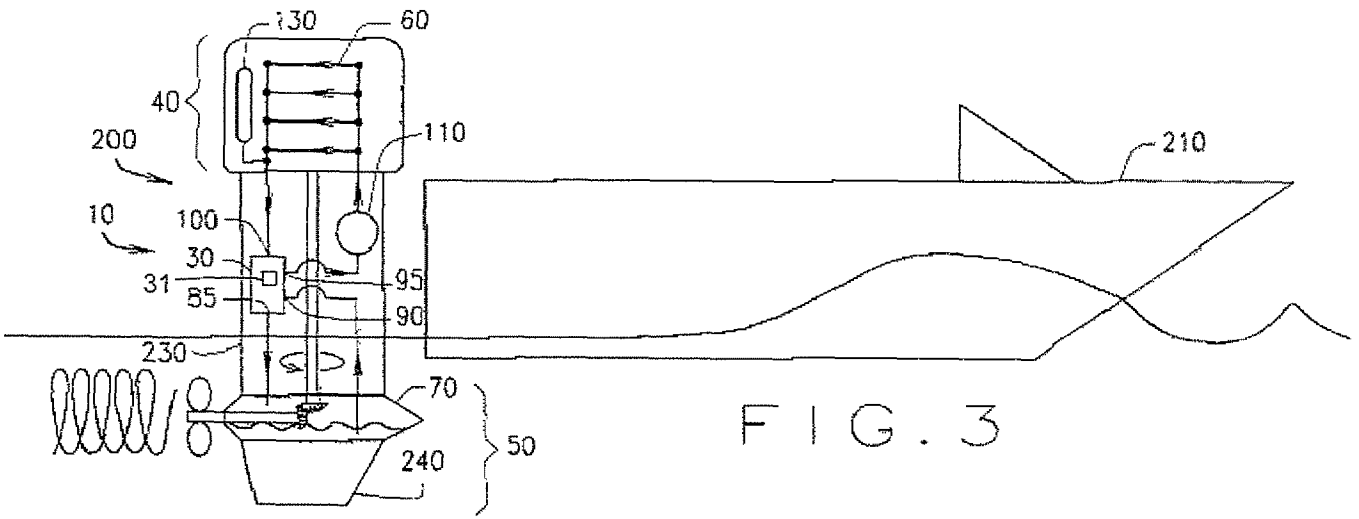
FIG. 3 is a view of the outboard motor incorporating the closed loop cooling system with the cooling fluid in common with the gearbox in the heat dissipation mode.

FIGS. 2 and 3 are views of an outboard motor 200 on a boat 210 incorporating the closed loop cooling system 10 with the cooling fluid in common with the gearbox 70. As such, the cooling fluid is lubricating the gears in the gearbox 70 and is also being pumped or transferred through the cooling system 10 to cool the outboard motor 200. The gearbox 70, submerged in the water, provides the heat dissipation member. The closed loop cooling system 10 of FIG. 2 is in the heat preservation mode, while FIG. 3 shows the heat dissipation mode. The outboard motor 200 comprises the fluid cooling jackets 60 in fluidic communication with the motor cooling circuit 40.

In embodiments where the cooling fluid and the gear lubricant are in common, oil needs to be used as the cooling fluid. Advantageously, this provides an increased volume of oil servicing the gearbox 70. An additional one or more oil filters may be optionally added in fluidic communication with the motor cooling circuit 40 or the heat dissipation circuit 50 to assist in providing cleaner, filtered oil for the gearbox 70.

When the outboard motor 200 is "cold," for example, when the outboard motor 200 has not been operated recently, the temperature control valve 30 will shut off the flow of the cooling fluid into the heat dissipation circuit 50. By bypassing the heat dissipation circuit 50, the cooling fluid is not circulated through the gearbox 70 for cooling. The outboard motor 200 thus heats up faster than a motor using a conventional cooling system that is operated as soon as the motor is started. The gearbox 70 operates more efficiently at warmer temperatures provided by the "warmed" cooling fluid from the motor cooling circuit 40 traveling to the gearbox 70 during the heat dissipation mode, since the gearbox 70 is warmed and thus has less friction caused by the high viscosity of cool oil, thereby reducing the drag on the gearbox 70.

As such, during the heat preservation mode, the cooling fluid is only circulating in the motor cooling circuit 40, which provides for the heat to be maintained in the outboard motor 200 until the outboard motor 200 quickly warms to a preferred operating temperature because no heat is being dissipated in this mode of operation. When the operating temperature of the outboard motor 200 rises to reaches a certain lower threshold temperature of the temperature control valve 30, the temperature control valve 30 will open the flow of the cooling fluid into the heat dissipation circuit 50, such that cooling fluid leaves the temperature control valve 30 at the heat dissipation circuit outlet port 85, travels through the heat dissipation circuit 50 for heat dissipation, and then the now cooled cooling fluid enters the temperate control valve 30 at the heat dissipation circuit inlet port 90.

Likewise, when the operating temperature of the outboard motor 200 falls to reaches a certain upper threshold temperature of the temperature control valve 30, the temperature control valve 30 will close or reduce flow of the cooling fluid into the heat dissipation circuit 50, such that no or less cooling fluid enters the heat dissipation circuit 50 for cooling.

The lower and upper threshold temperatures may define an optimal operating range for a particular motor. The lower and upper threshold temperatures may vary depending upon the particular motor or the performance desired. For example, an optimal temperature range for some outboard motors is approximately 170°-190° F. In this example, the 170° F. is the lower threshold and the 190° F. is the upper threshold. Of course, the optimal operating ranges will vary between different outboards motors and different marine engines, and further in view of different operating conditions and performance requirements. The temperature control valve 30 may be mechanically adjusted by changing a thermal actuator in the temperature control valve 30, which reacts at different temperatures in order to define different optimal operating ranges.

The primary function of the temperature control valve 30 is to provide the heat management for the motor, in this example, the outboard motor 200. This is accomplished by making fluidic connection with the heat dissipation circuit 50 to dissipate motor heat into the lake or sea water from the heat dissipation member when the cooling fluid temperature rises above a set point or lower threshold of the valve 30, and to by-pass or disconnect the heat dissipation circuit 50 to preserve heat when the oil temperature drops below a set point or upper threshold of the valve 30. The valve 30 also operates in incremental positions to send a proportion of the cooling fluid flow into the heat dissipation circuit 50, if that is what the real time heat rejection demand is.

The temperature control valve 30 may also operate in the incremental or partial manner, i.e., the temperature control valve may open and close the cooling fluid to the heat dissipation circuit 50 to permit a portion or percentage of the cooling fluid flow in the cooling system 10 to enter the heat dissipation circuit 50. For example, the temperature control valve 30 may actuate to send 10%, 25%, 40%, etc. of the cooling fluid flow through the heat dissipation circuit 50.

The cooling fluid is circulated within the fluid cooling jackets 60, the motor cooling circuit 40, and the heat dissipation circuit 50 via conduits, ducting, hosing, piping, etc. with appropriate marine motor grade connectors. The fluid cooling jackets 60 for marine motors are commonly used to circulate raw water about an engine.

Figure 4:
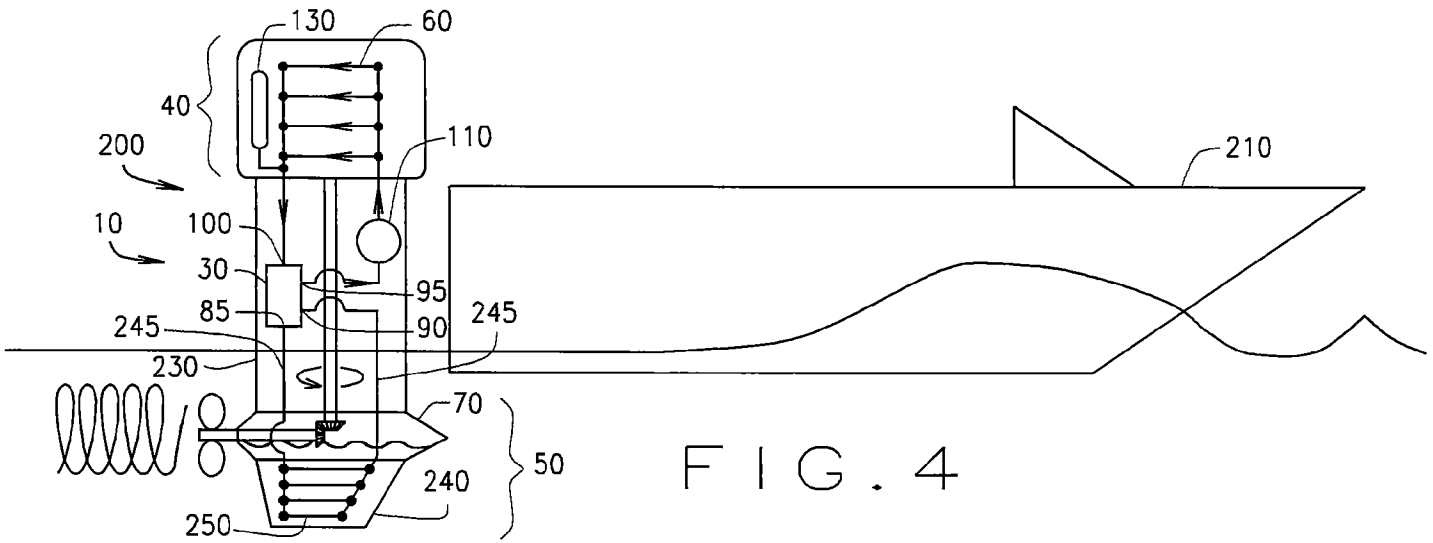
FIG. 4 is a view of the outboard motor incorporating the closed loop cooling system with the cooling fluid independent of the gearbox in the heat preservation mode.
Figure 5:
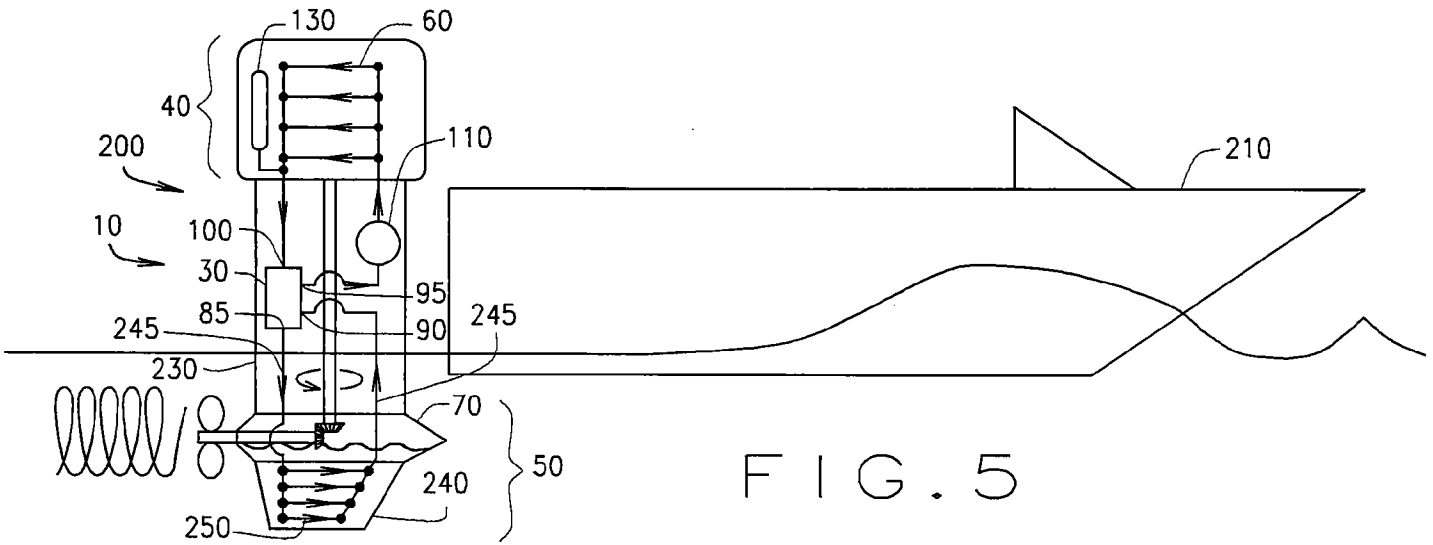
FIG. 5 is a view of the outboard motor incorporating the closed loop cooling system with the cooling fluid independent of the gearbox with the cooling fluid passing through the directional control skeg in the heat dissipation mode.

FIG. 4 is a view the outboard motor 200 incorporating the closed loop cooling system 10 with the cooling fluid independent of the gearbox 70 in the heat preservation mode, while FIG. 5 is a view the outboard motor 200 incorporating the closed loop cooling system 10 with the cooling fluid independent of the gearbox 70 in the heat dissipation mode.

In this embodiment, the cooling fluid is maintained separate and independent from the lubricant in the gearbox 70. The heat dissipation circuit 50 is in closed fluidic communication with a directional control skeg 240 of the lower unit of the outboard motor 200 for cooling the cooling fluid. The cooling fluid is pumped or transferred via a conduit 245, such as ducting, hosing, piping, etc., to and from the directional control skeg 240, such that heat may be transferred from the cooling fluid in the directional control skeg 240, through the directional control skeg 240, and into the passing lake/sea water. The directional control skeg 240, submerged in the water, provides the heat dissipation member. The cooling fluid circulates through internal cooling passages 250 within the directional control skeg 240, which are in close proximity to the water.

Figure 6:
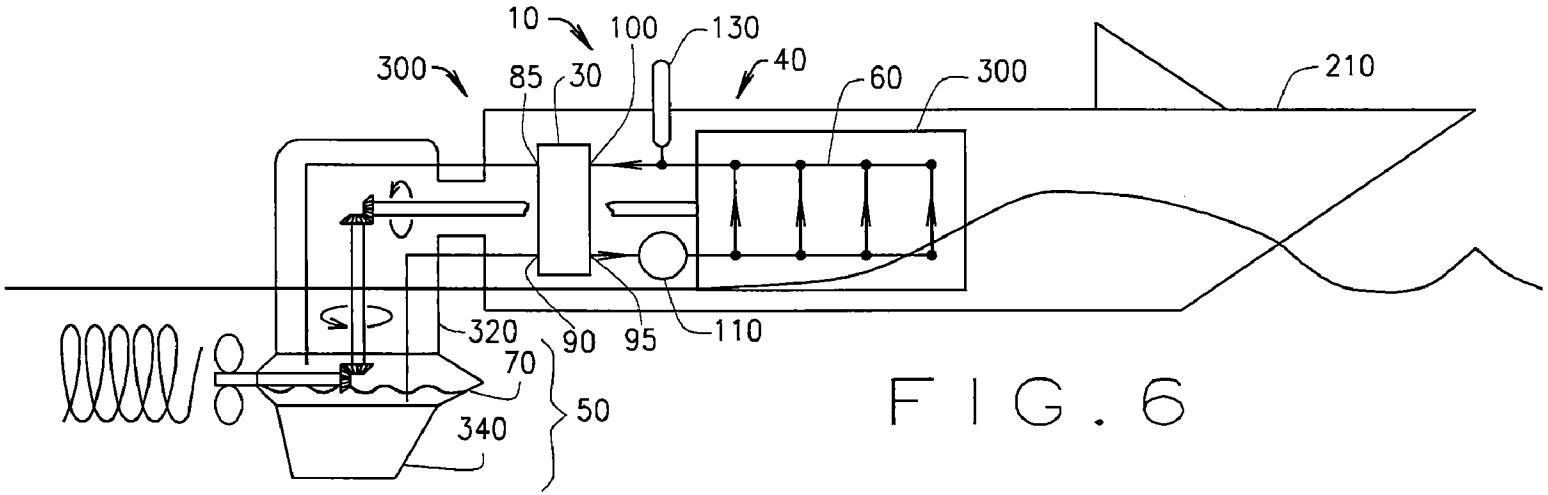
FIG. 6 is a view of the inboard-outboard motor incorporating the closed loop cooling system with the cooling fluid in common with the gearbox in the heat preservation mode.
Figure 7:
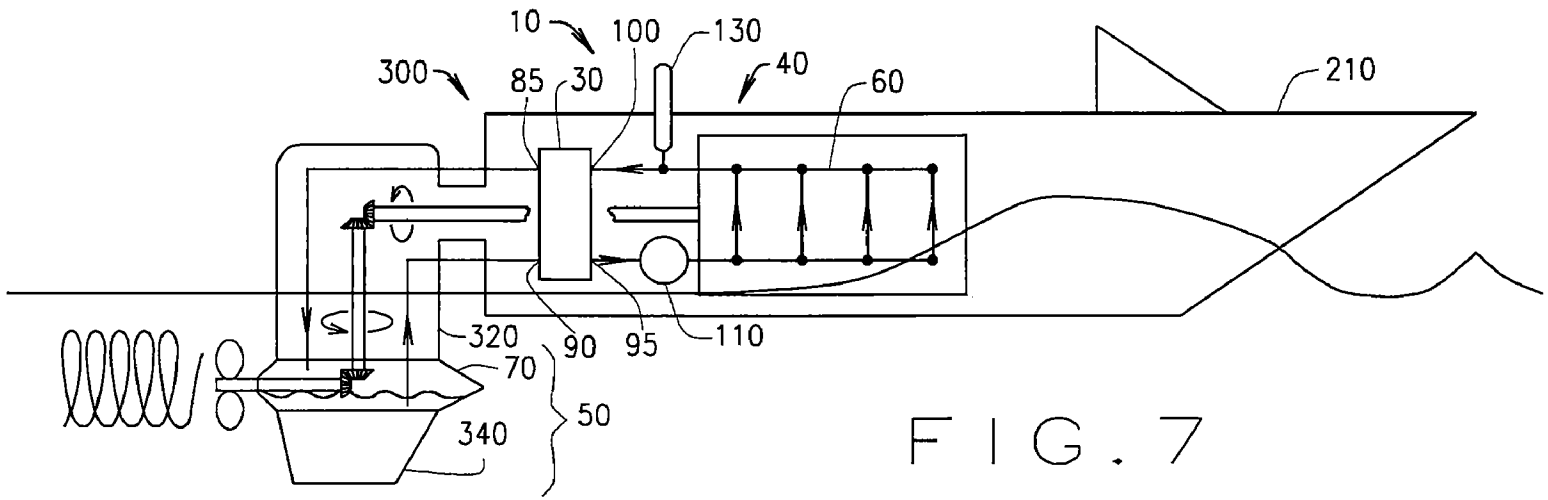
FIG. 7 is a view of the inboard-outboard motor incorporating the closed loop cooling system with the cooling fluid in common with the gearbox in the heat dissipation mode.

FIG. 6 is a view the inboard-outboard motor 300 incorporating the closed loop cooling system 10 with the cooling fluid in common with the gearbox 70 in the heat preservation mode, while FIG. 7 is a view the inboard-outboard motor 300 incorporating the closed loop cooling system with the cooling fluid in common with the gearbox 70 in the heat dissipation mode. The inboard portion of the motor 300 is shown in the boat 210, while the outboard portion of the motor 300, the lower unit 320, is partially submerged in water. The cooling fluid is lubricating the gears in the gearbox 70 and is also being pumped or transferred through the cooling system 10 to cool the inboard-outboard motor 300 via the fluid cooling jackets 60. The gearbox 70 provides the heat dissipation member.

Figure 8:
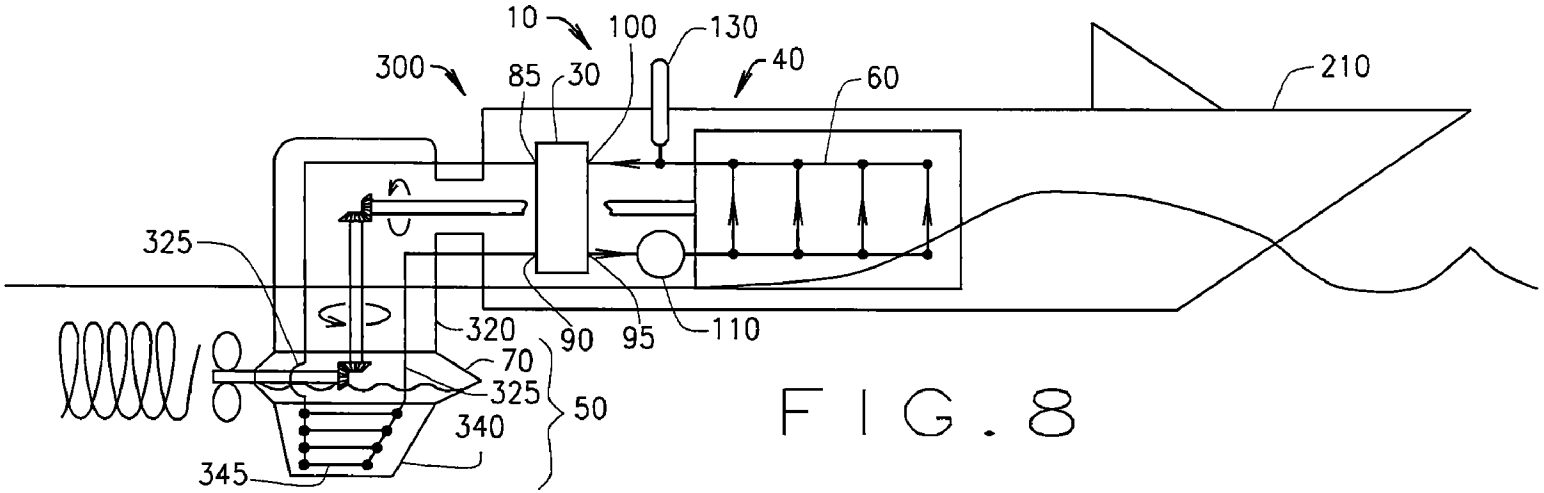
FIG. 8 is a view of the inboard-outboard motor incorporating the closed loop cooling system with the cooling fluid independent of the gearbox and passing through the directional control skeg in the heat preservation mode.
Figure 9:
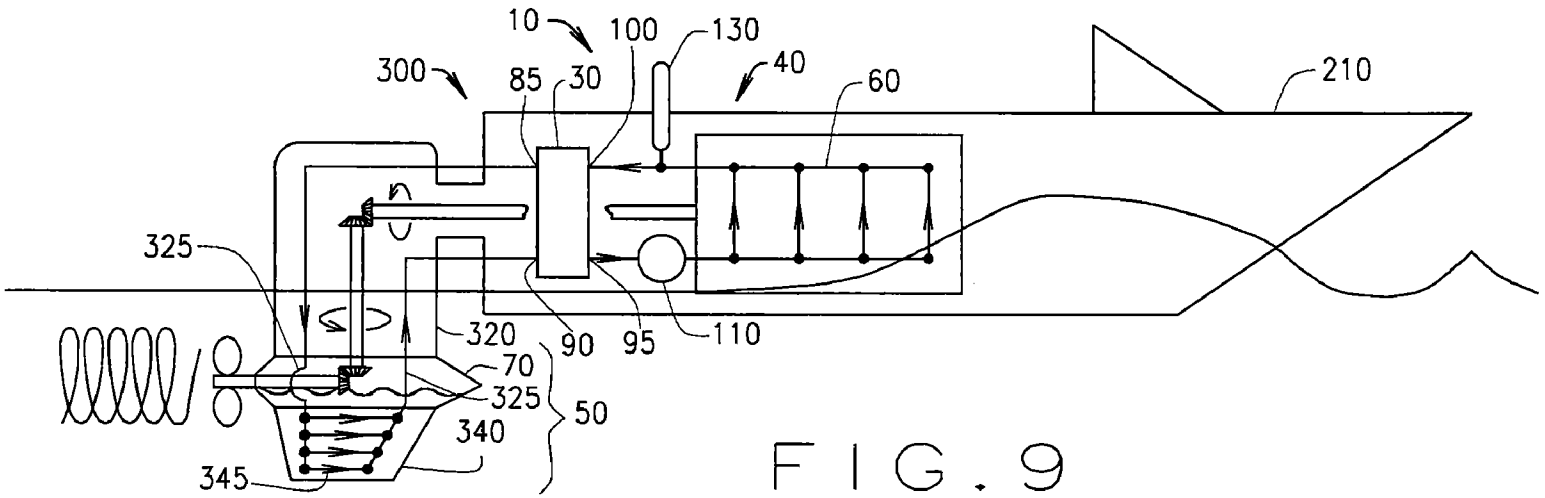
FIG. 9 is a view the inboard-outboard motor incorporating the closed loop cooling system with the cooling fluid independent of the gearbox and passing through the directional control skeg in the heat dissipation mode.

In another embodiment, as shown in FIGS. 8 and 9, the heat dissipation circuit 50 is in closed fluidic communication with a directional control skeg 340 of the lower unit 320 of the inboard-outboard motor 300 for cooling the cooling fluid. FIG. 8 shows the heat preservation mode, while FIG. 9 shows the heat dissipation mode. In this embodiment, the cooling fluid is maintained separate and independent from the lubricant in the gearbox 70. The cooling fluid is pumped or transferred via a conduit 325, such as ducting, hosing, piping, etc., to fluid passages 345 in the directional control skeg 340, such that heat may be transferred from the cooling fluid in fluid passages 345 of the directional control skeg 340, through the directional control skeg 340, and into the passing lake/sea water. The directional control skeg 340, submerged in the water, provides the heat dissipation member.

Figure 10:
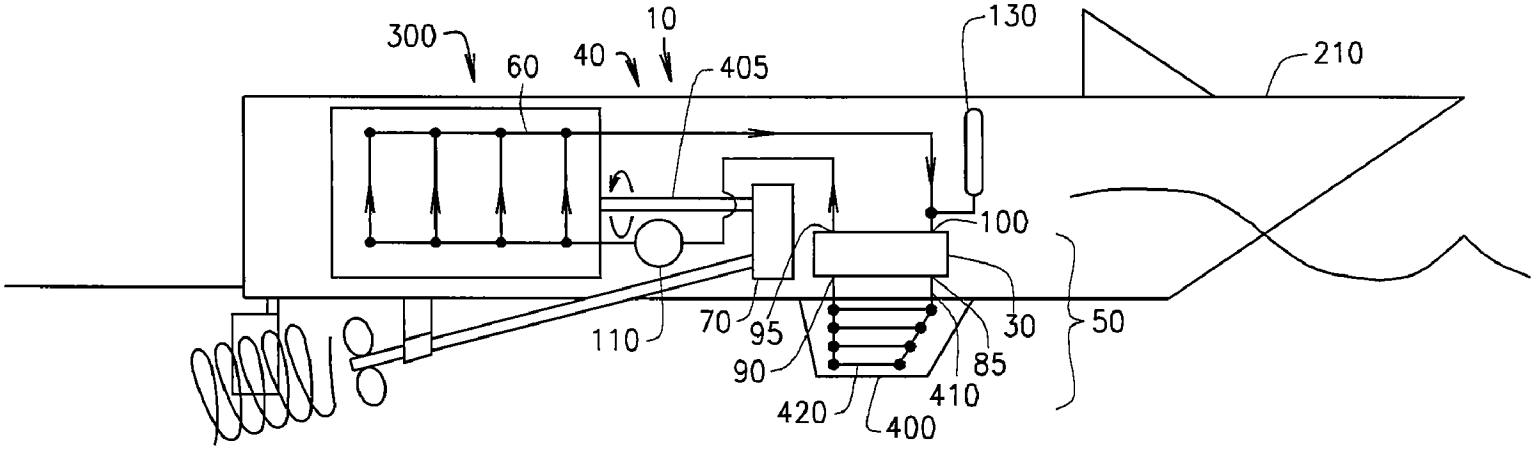
FIG. 10 is a view of the inboard motor incorporating the closed loop cooling system with the cooling fluid passing through the hull fin in the heat preservation mode.
Figure 11:
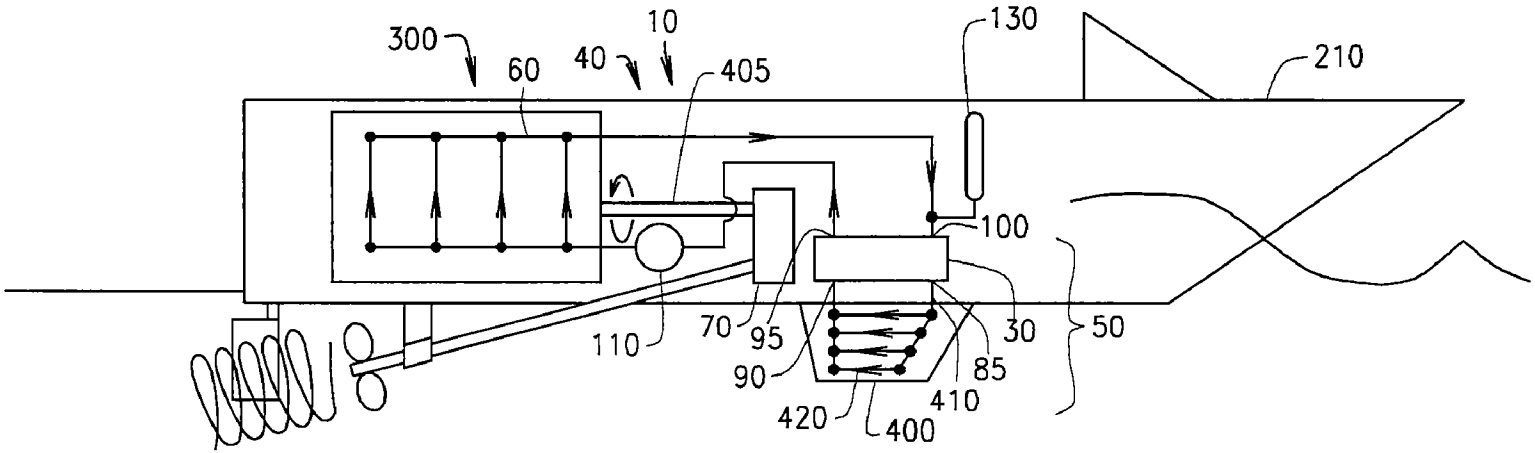
FIG. 11 is a view the inboard motor incorporating the closed loop cooling system with the cooling fluid passing through the hull fin in the heat dissipation mode.

In another embodiment as shown in FIGS. 10 and 11, the motor cooling circuit 40 is in closed fluidic communication with a submerged device or structure for cooling the cooling fluid attached to the bottom side of the boat hull. In FIGS. 10 and 11, the cooling fluid is pumped or transferred via conduits, ducting, hosing, piping, etc. to the submerged device or structure on or in the keel, the stern of the boat 210, the hull of the boat 210 or other underwater boat structure in contact with or in close proximity to the passing lake/sea water, such that heat may be transferred from the device or structure to the passing lake/sea water. A fin 400 is shown in FIGS. 10 and 11 as the submerged device or structure that is in close contact with the passing lake/sea water. The fin 400, submerged in the water, provides the heat dissipation member. The fin 400 comprises passages 420 in fluidic communication with the temperature control valve 30 via a conduit 410 as part of the heat dissipation circuit 50.

The fin 400 extends downward from the hull of the boat 210 into the water. The device or structure for dissipating the heat may also include, for example, a plate, or other heat exchanger submerged in water that provides for the cooling fluid to circulate in close proximity to the water, which provides a heat sink to receive the heat from the motor cooling circuit 40. The heat dissipation device may be integrated into a submerged portion of a hull of the boat 210.

In other embodiments, the fin 400 may include one or more horizontal fins or members that horizontally extend from the fin 400 to improve heat rejection. The passages 420 extend into these horizontal fins for the cooling of the cooling fluid. The one or more horizontal fins or members create additional contact area for heat dissipation with the passing water.

In the embodiments of FIGS. 10 and 11, the gearbox 70 is in operational engagement with a drive shaft 405 from the motor 300. The lubricant in the gearbox 70 is independent of the cooling fluid in FIGS. 10 and 11, although a common cooling fluid may be used as the gearbox lubricant, as described elsewhere herein. FIG. 10 shows the cooling system 10 in the heat preservation mode, while FIG. 11 shows the cooling system in the heat dissipation mode.

The cooling fluid contained in the closed loop cooling system 10 may include oil, synthetic oil, other "metal friendly" liquids, such as ethanol glycol and propylene glycol. The cooling fluid should provide for transfer of the heat, while not causing maintenance problems to the motor or to the boat. For example, a fluid that freezes at normal freezing temperatures of approximately 320 degrees F. would not be suitable for use as the cooling fluid. In general, water is destructive to metal. Oil is an excellent coolant and does not oxide metal, and oil will not boil or freeze. Water can carry much more heat than oil. However, marine motors do not require their cooling systems to carry much heat. For example, an outboard motor does not require water to cool because it can dump so much heat so fast into the passing lake/sea water. As such, the motor engine may be cooled with oil. Oil is also more thermally conductive and thermally reactive than water, thereby improving the cooling system performance reaction time.

The closed loop cooling system using oil provides many advantages. Rust, scaling, corrosion, electrolysis, and potential problems from freezing are reduced or eliminated. Longer motor life may be achieved by avoiding such problems. The motor may always be operated at the optimum operating temperature, which provides for optimum power, responsiveness, fuel efficiency, and reduced exhaust emissions. The cooling system 10 does not require an annual flushing or winterization process or a clean water flush after each use in salt water.

The pump 110 creates the flow of the cooling fluid through the cooling system 10. The pump 110 can be powered by either a direct drive, an electrical motor, a water turbine powered by boat movement, or any combination of these. For outboard marine motors, one pump which provides a flow rate of approximately 0.5 to approximately 1.0 gallons per minute is adequate, although other pumps with different flow rates may be used depending upon the size of the particular motor and the cooling demand of the particular motor. The cooling system 10 may incorporate one or more pumps 110 in order to accommodate the size of the particular motor and the cooling demand of the particular motor.

The cooling system 10 provides the heat dissipation member that is hydraulically isolated from the body of water. As such, water does not pass from the lake or sea into the heat dissipation member and through to the heat dissipation circuit 50. The heat dissipation member is in indirect thermal communication with the body of water to dissipate heat from the motor cooling circuit 40 and the heat dissipation circuit 50 without exchanging water from the body of water into or with the cooling system 10.

One suitable temperature control valve 30 is a thermally-actuated multi-port valve, which is a kinetically-actuated variable link between the motor and the raw lake or sea water heat dissipation system. This valve continually actuates and adjusts on demand and maintains the optimum operating temperature of the motor by adjusting when and how much cooling fluid flow is directed into the motor cooling circuit 40. As a result, the closed loop cooling system 10 desirably manages the operating temperature of the motor within a narrow, predetermined temperature range to provide consistent improved motor performance.

One suitable thermal actuated multi-port valve for use in the cooling system 10 is a GEARZMO gearbox oil temperature control valve commercially available from Vapor Trail Racing, LLC in Denver, Colo. The temperature control valve may include a thermally reactive wax motor actuator. An operator selects the temperature actuator to fit the needs of the engine. When the temperature of the cooling fluid rises to the melt point of the wax, the wax melts, liquefies and expands in volume. The increase in volume of the wax pushes a piston which in turn pushes a valve flow diverter. In the HOT position, with the wax melted, the valve connects the motor cooling circuit 40 with the heat dissipation circuit 50. Conversely, when the fluid temperature drops below the wax melt point, the wax re-solidifies and the valve flow diverter returns to its COLD position, by-passing the heat dissipation circuit 50. The temperature control valve 30 may include a spring-loaded mechanism to push the valve flow diverter back to the COLD position. The valve 30 basically connects and disconnects the motor cooling circuit 40 with the heat dissipation circuit 50 as per the motor's real heat dissipation needs. At a higher level, the valve controls the flow of the fluid proportionately—for example, the valve may elect to only send 25% of the flow into the heat dissipation circuit (this is the art of engine temp control). This may be accompanied by using a mix of different waxes—and the different waxes melt one at a time providing proportionate positioning of the valve flow diverter.

The cooling system 10 may be included with or adapted to a wide variety of marine motors, such as, for example, outboards, inboards, inboard-outboards, jet drives, etc. The cooling system 10 may be included with or adapted to a wide variety of marine vessels and to different vessels across the entire spectrum of marine vessels with application in the cooling systems of personal watercraft to application in the cooling systems of cruisers.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

The invention claimed is:

1. A closed loop fluid cooling system for marine motors, comprising:

a motor cooling circuit in fluidic communication with fluid cooling jackets proximate to a motor;

a heat dissipation circuit;

the motor cooling circuit in closed fluidic communication with the heat dissipation circuit;

a cooling fluid that circulates between the motor cooling circuit and the heat dissipation circuit;

a heat dissipation member in fluidic communication with the heat dissipation circuit to receive the circulating cooling fluid, and the heat dissipation member submerged in a body of water to transfer heat from the cooling fluid to the body of water;

a temperature control valve in fluidic communication with the motor cooling circuit and the heat dissipation circuit; and the temperature control valve connects the motor cooling circuit and the heat dissipation circuit in response to a temperature change of the cooling fluid or the motor to provide for the circulation of the cooling fluid between the motor cooling circuit and the heat dissipation circuit.

2. The closed loop fluid cooling system according to claim 1, wherein the temperature control valve provides flow of the cooling fluid to the heat dissipation circuit after a temperature of the cooling fluid rises to a threshold level.

3. The closed loop fluid cooling system according to claim 1, wherein the flow of the cooling fluid from the motor cooling circuit to the heat dissipation circuit is shut off, and a temperature of a gearbox is raised.

4. The closed loop fluid cooling system according to claim 1, wherein the heat dissipation member is in indirect thermal communication with the body of water to dissipate heat from the motor cooling circuit; wherein the heat dissipation member is isolated from the body of water.

5. The closed loop fluid cooling system according to claim 1, wherein the closed loop cooling system does not draw water from the body of water into the motor cooling circuit, the heat dissipation circuit, or the heat dissipation member.

6. The closed loop fluid cooling system according to claim 1, wherein the heat dissipation circuit is in fluidic communication with gearbox lubricant in a gearbox that is operably connected with the motor, with fluid cooling jackets of the gearbox, with fluid passages of a directional control skeg, with fluid passages within a submerged fin, or with a heat dissipation device integrated into a submerged portion of a boat hull.

7. The closed loop fluid cooling system according to claim 1, wherein the cooling fluid circulates in the motor cooling circuit and the heat dissipation circuit to control heat dissipation from the motor, and the cooling fluid circulates in a gearbox to lubricate gears in the gearbox.

8. The closed loop fluid cooling system according to claim 1, wherein the cooling fluid is oil.

9. The closed loop fluid cooling system according to claim 1, further comprising one or more pumps in fluidic communication with the closed cooling system in order to transfer the cooling fluid between the motor cooling circuit and the heat dissipation circuit, and further comprising one or more fluid filters in fluidic communication with the closed cooling system.

10. The closed loop fluid cooling system according to claim 1, wherein the temperature control valve opens and fluidly connects the motor cooling circuit with the heat dissipation circuit after a temperature of the engine or a temperature of the fluid raises to a lower threshold temperature.

11. The closed loop fluid cooling system according to claim 1, wherein the valve closes and disconnects the heat dissipation circuit from the motor cooling circuit after a temperature of the motor or the fluid falls to a threshold temperature.

12. The closed loop fluid cooling system according to claim 1, wherein the valve comprises a thermal actuator.

13. The closed loop fluid cooling system according to claim 12, wherein the thermal actuator comprises a wax-based thermal actuator.

14. The closed loop fluid cooling system according to claim 1, wherein the temperature control valve is configured to permit a partial or complete flow of the cooling fluid through the heat dissipation circuit.

15. The closed loop fluid cooling system according to claim 1, wherein the heat dissipation member is a gearbox that is operably connected with the motor, a lower unit that is operably connected with the motor, a skeg of the motor, a fin extending downward from a hull of a boat, or a heat dissipation device integrated into a submerged portion of the hull of the boat.

16. A marine vessel having a motor for propelling the marine vessel, the motor having a fluid cooling system, the improvement comprising:

a motor cooling circuit in fluidic communication with fluid cooling jackets proximate to the motor;

a heat dissipation circuit;

the motor cooling circuit in closed fluidic communication with the heat dissipation circuit;

a cooling fluid that circulates between the motor cooling circuit and the heat dissipation circuit;

a heat dissipation member in fluidic communication with the heat dissipation circuit to receive the circulating cooling fluid, and the heat dissipation member submerged in a body of water on which the marine vessel is afloat to transfer heat from the cooling fluid to the body of water; and a thermostatic control comprising a heat dissipation mode for operating the cooling system and a heat preservation mode for operating the cooling system, wherein the heat dissipation mode permits or causes flow of the cooling fluid from the motor cooling circuit to the heat dissipation circuit and the heat preservation circuit stops flow of the cooling fluid from the motor cooling circuit to the heat dissipation circuit.

17. A method of controlling an operating temperature of a marine motor, comprising:

providing a cooling system for the marine motor, comprising:

a motor cooling circuit in fluidic communication with fluid cooling jackets about proximate to the marine motor;

a heat dissipation circuit;

the motor cooling circuit in closed fluidic communication with the heat dissipation circuit;

a cooling fluid that circulates between the motor cooling circuit and the heat dissipation circuit;

a heat dissipation member in fluidic communication with the heat dissipation circuit to receive the circulating cooling fluid, and the heat dissipation member submerged in a body of water to transfer heat from the cooling fluid to the body of water; and a temperature control valve in fluidic communication with the motor cooling circuit and the heat dissipation circuit;

actuating the temperature control valve to permit flow of the cooling fluid from the motor cooling circuit to the heat dissipation circuit; and actuating the temperature control valve to shut off flow of the cooling fluid from the motor cooling circuit to the heat dissipation circuit.

18. The method of controlling an operating temperature of a marine motor according to claim 17, further comprising actuating the temperature control valve to permit flow of the cooling fluid from the motor cooling circuit to the heat dissipation circuit when a temperature of the motor has raised to a predetermined upper threshold temperature.

19. The method of controlling an operating temperature of a marine motor according to claim 17, further comprising actuating the temperature control valve to shut off flow of the cooling fluid from the motor cooling circuit to the heat dissipation circuit when a temperature of the motor has lowered to a predetermined lower threshold temperature.

20. The method of controlling an operating temperature of a marine motor according to claim 17, further comprising indirectly dissipating heat to the body of water from the heat dissipation circuit.

21. The method of controlling an operating temperature of a marine motor according to claim 17, further comprising elevating a temperature of a submerged gearbox.

* * * * *